US008785758B2

(12) United States Patent
Wissmuller

(10) Patent No.: US 8,785,758 B2
(45) Date of Patent: Jul. 22, 2014

(54) ELECTRONIC HI-HAT CYMBAL CONTROLLER

(75) Inventor: Jan Wissmuller, Sarasota, FL (US)

(73) Assignee: InMusic Brands, Inc., Cumberland, RI (US)

( * ) Notice: Subject to any disclaimer, the term of this patent is extended or adjusted under 35 U.S.C. 154(b) by 173 days.

(21) Appl. No.: 13/220,990

(22) Filed: Aug. 30, 2011

(65) Prior Publication Data

US 2012/0048099 A1 Mar. 1, 2012

Related U.S. Application Data

(60) Provisional application No. 61/379,147, filed on Sep. 1, 2010, provisional application No. 61/393,569, filed on Oct. 15, 2010.

(51) Int. Cl.
*G10H 1/18* (2006.01)

(52) U.S. Cl.
USPC ..... 84/615; 84/653; 84/422.3; 84/721

(58) Field of Classification Search
USPC ..... 84/600–602, 615, 653, 422.3, 721
See application file for complete search history.

(56) References Cited

U.S. PATENT DOCUMENTS 3,999,457 A * 12/1976 Michel ..... 84/702
4,361,069 A * 11/1982 Peterson et al. ..... 84/346
5,012,086 A * 4/1991 Barnard ..... 250/222.1
5,237,126 A * 8/1993 Curtis et al. ..... 84/724
5,641,925 A * 6/1997 Koseki ..... 84/462
5,659,145 A * 8/1997 Weil ..... 84/464 R
5,824,930 A * 10/1998 Ura et al. ..... 84/462
5,834,669 A * 11/1998 Clift et al. ..... 84/462
6,297,437 B1 * 10/2001 Ura et al. ..... 84/423 R
6,815,604 B2 * 11/2004 Toda ..... 84/746
7,132,643 B2 * 11/2006 Kato ..... 250/221
7,294,778 B2 11/2007 Susami
7,473,834 B2 * 1/2009 Yoshino ..... 84/402
7,560,638 B2 * 7/2009 Susami ..... 84/723
7,589,275 B2 * 9/2009 Arimoto ..... 84/723
7,838,753 B2 * 11/2010 Steele ..... 84/422.1
7,902,448 B2 * 3/2011 Kikumoto et al. ..... 84/615
8,344,235 B2 * 1/2013 Steele ..... 84/615
8,410,348 B1 * 4/2013 Hsieh ..... 84/743
2001/0007218 A1 * 7/2001 Tamaki et al. ..... 84/20
2003/0200860 A1 * 10/2003 Toda ..... 84/746
2005/0145101 A1 * 7/2005 Yoshino ..... 84/723
2005/0257672 A1 * 11/2005 Arimoto ..... 84/738
2006/0096448 A1 5/2006 Yoshino et al.
2006/0156910 A1 7/2006 Yoshino
2006/0162534 A1 * 7/2006 Muramatsu ..... 84/724
2006/0185497 A1 * 8/2006 Hirota et al. ..... 84/423 R
2009/0100993 A1 * 4/2009 Komatsu ..... 84/724
2009/0151548 A1 * 6/2009 Kikumoto et al. ..... 84/640
2009/0178547 A1 * 7/2009 Hirano ..... 84/745
2009/0282962 A1 * 11/2009 Jones et al. ..... 84/21

(Continued)

*Primary Examiner* — David S. Warren
(74) *Attorney, Agent, or Firm* — Finnegan, Henderson Farabow, Garrett & Dunner, LLP

(57) ABSTRACT

An electronic hi-hat cymbal controller is disclosed. The controller includes a hi-hat cymbal stand with a foot pedal configured and arranged to mechanically lift a control shaft. A lower cymbal is supported by the hi-hat cymbal stand. An upper cymbal is supported by the control shaft and oriented over the lower cymbal. And a position detector is configured and arranged to detect the position of the control shaft relative to the hi-hat cymbal stand.

21 Claims, 7 Drawing Sheets

(56) References Cited

U.S. PATENT DOCUMENTS

2010/0180750 A1* 7/2010 Steele ..... 84/422.3
2010/0307319 A1* 12/2010 Kani ..... 84/485 R
2011/0056361 A1* 3/2011 Steele ..... 84/422.3
2012/0048099 A1* 3/2012 Wissmuller ..... 84/723
2013/0047826 A1* 2/2013 Wissmuller ..... 84/723

* cited by examiner

ELECTRONIC HI-HAT CYMBAL CONTROLLER

CROSS-REFERENCE TO RELATED APPLICATIONS

The present patent document claims priority to earlier filed U.S. Provisional Application Ser. No. 61/379,147, filed on Sep. 1, 2010, and U.S. Provisional Application Ser. No. 61/393,569, filed on Oct. 15, 2010, the entire contents of which are incorporated herein by reference.

BACKGROUND OF THE INVENTION

1. Field of the Invention

The present invention relates generally to cymbals for making music and more particularly to an electronic high-hat cymbal controller.

2. Background of the Related Art

Electronic drum sets generally consist of controllers whose look and feel emulates the instruments of an acoustic drum set and electronic sound generators which take input from these controllers and produce electronically synthesized drum set sounds.

A typical electronic drum set will include some number of "electronic cymbals", that is, controllers whose shape and design makes them suitable for emulating the playing characteristics of various acoustic cymbals.

One important cymbal type is the high-hat shown in FIG. 1 at 10. An acoustic high-hat consists of two cymbals 12, 14, mounted in a stand 16 with a foot pedal 18. The cymbals 12, 14 are mounted with the concave sides facing each other and the upper cymbal 12 can be moved down and up by pressing and releasing the foot pedal 18. Typically, the top cymbal 12 is struck by the performer and the resulting sound varies, depending on whether the upper cymbal 12 is down and in contact with the lower cymbal 14 (referred to as closed) or up and not in contact (referred to as open). Subtle effects in timbre are available to the performer with the hi-hat cymbal 10 partially closed (nearly touching), lightly closed, closed hard and with the upper cymbals 12 struck in such a way that it swings down and strikes the lower cymbal 14. In addition, the hi-hat cymbal 10 can be made to "speak" by pressing the pedal 18 quickly and holding it closed (often called a "tcchk") and by pressing the pedal 18 till the cymbals 12, 14 touch and releasing quickly (referred to as a "foot splash" or "pedal splash").

In current practice, the electronic implementation of a high-hat cymbal controller typically takes the form of two controllers, one that emulates the upper cymbal and one that emulates the action of the foot pedal.

The upper cymbal controller is similar to the controllers for other cymbals. In the simplest form, it has a sensor, typically a piezo-electric device, that indicates how hard the cymbal has been struck. It is possible, as with other cymbals, to add additional detectors to indicate where the cymbal has been struck (bell, bow or edge). It is also possible, as with other cymbals, to add a detector that will detect a choke. On cymbals that are not a high-hat pair, this is often a membrane switch that detects the performer damping the cymbal vibration with his hand. Typically, the lower cymbal of the acoustic high-hat pair is not present in an electronic drum set.

The foot pedal controller frequently takes the form of a stand-alone foot-pedal, shown in FIG. 2 at 20, completely separated from the cymbal(s). This device detects how far the pedal is depressed by the performer and sends this data to the drum synthesizer.

The completely separate electronic foot pedal has a number of deficiencies. First, since the pedal does not move the upper cymbal up or down, the playing feel of the high-hat is quite different from the acoustic instrument it is meant to emulate. Second, the feel of the foot pedal itself is quite different from that of an acoustic high-hat cymbal 10. An acoustic high-hat cymbal 10 has a spring, which can be emulated by a stand-alone pedal. The acoustic high-hat pedal 18 also moves the mass of the upper cymbal 12 and control shaft 22, which is not emulated by a stand-alone pedal 20. Furthermore, the feel of the cymbals 12, 14 touching and compressing is poorly emulated by the stand-alone foot pedal 20. Finally, the visual presentation of the separated cymbal and stand-alone pedal pair is quite different from an acoustic high-hat 10.

A number of manufacturers have sought to address these deficiencies by mounting a single electronic cymbal controller on an acoustic high-hat stand 16. While this approach is an improvement over the stand-alone pedal, a number of deficiencies remain.

In particular, a single cymbal plays differently than two cymbals 12, 14. When an acoustic high-hat is open 10, the upper cymbal 12 swings freely when struck. When it closes, this swinging motion is suppressed and the resulting stiffness increases as the cymbals 12, 14 are further pressed together.

In addition, existing products require either a custom high-hat stand or a complete separate electronic drum set with an existing high-hat stand. For the drummer who switches between his electronic set (often a practice set) and acoustic set, this adds cost or inconvenience.

SUMMARY OF THE INVENTION

The electronic high-hat cymbal controller of the present invention solves the problems of the prior art by providing an upper cymbal and lower cymbal connected to a high-hat stand an operable with a foot pedal. A foot pedal control module detects the position of the upper cymbal relative to the foot pedal control cymbal and generates and transmits a control signal proportional to the plunger position to a drum synthesizer.

Among the objects of the electronic high-hat cymbal controller of the present invention is the provision for an electronic high-hat cymbal controller that includes two cymbals, with both cymbals swinging relatively freely when open and less freely when closed, emulating the behavior of an acoustic high-hat cymbal.

Another object of the present invention is an electronic high-hat cymbal controller that mounts the cymbals and the pedal controller onto existing acoustic high-hat cymbal stands.

Yet another object of the present invention is an electronic high-hat cymbal controller that has long life-expectancy.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
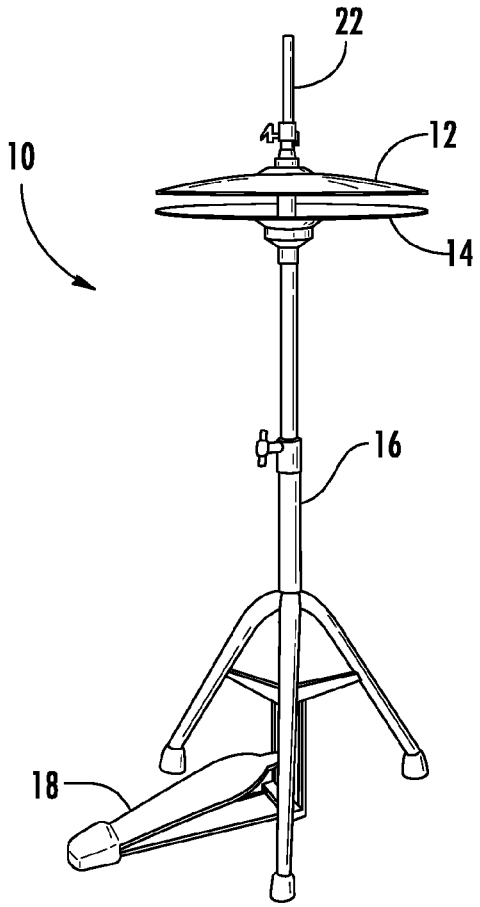
FIG. 1 (PRIOR ART)
FIG. 1 is a photographs of a prior art acoustic hi-hat cymbal.
Figure 2:
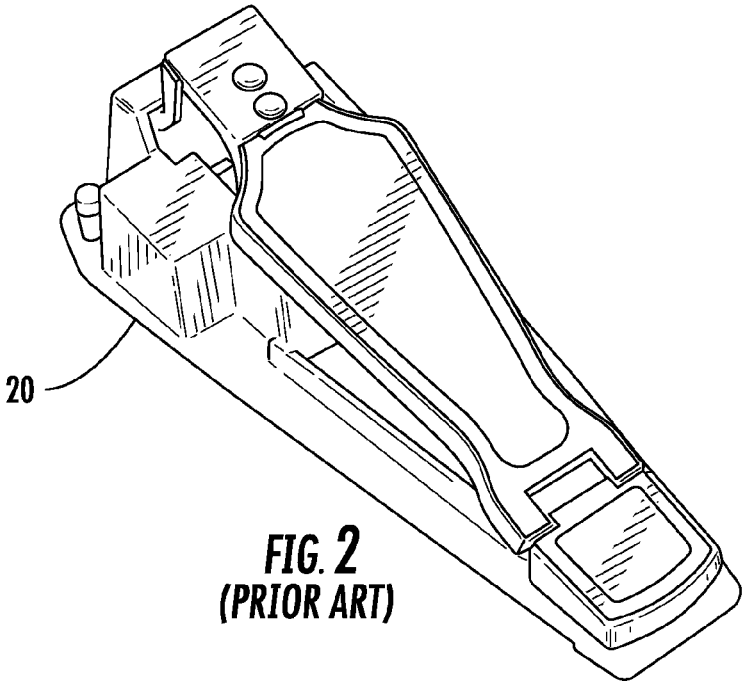
FIG. 2 (PRIOR ART)
FIG. 2 is a photograph of a prior art electronic foot pedal that simulates a hi-hat cymbal.
Figure 3A:
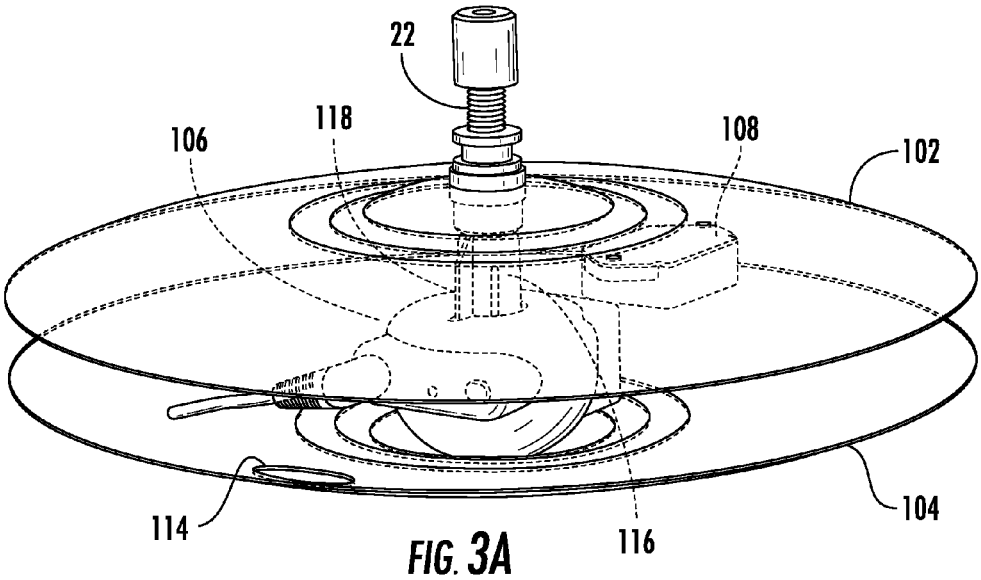
FIG. 3A is a perspective view of the electronic high-hat cymbal controller of the present invention with the cymbals open.
Figure 3B:
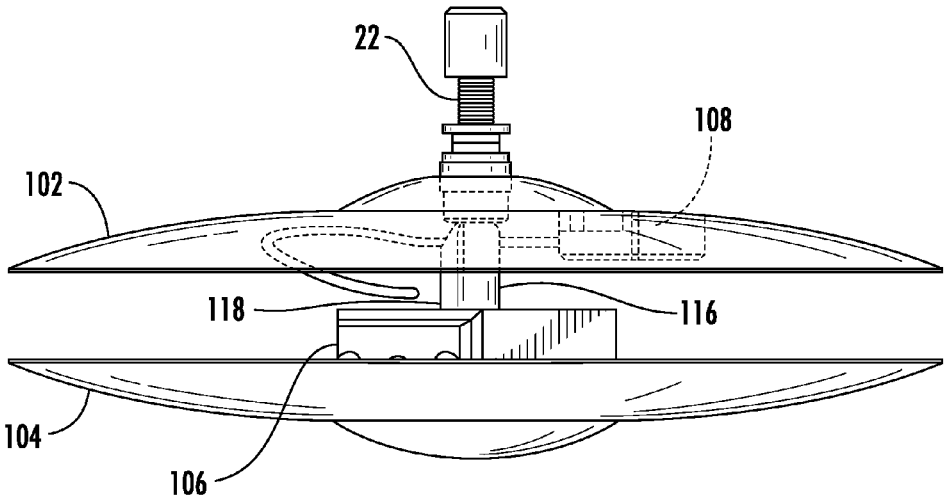
FIG. 3B is an elevation view of the electronic high-hat cymbal controller of the present invention with the cymbals open.
Figure 4A:
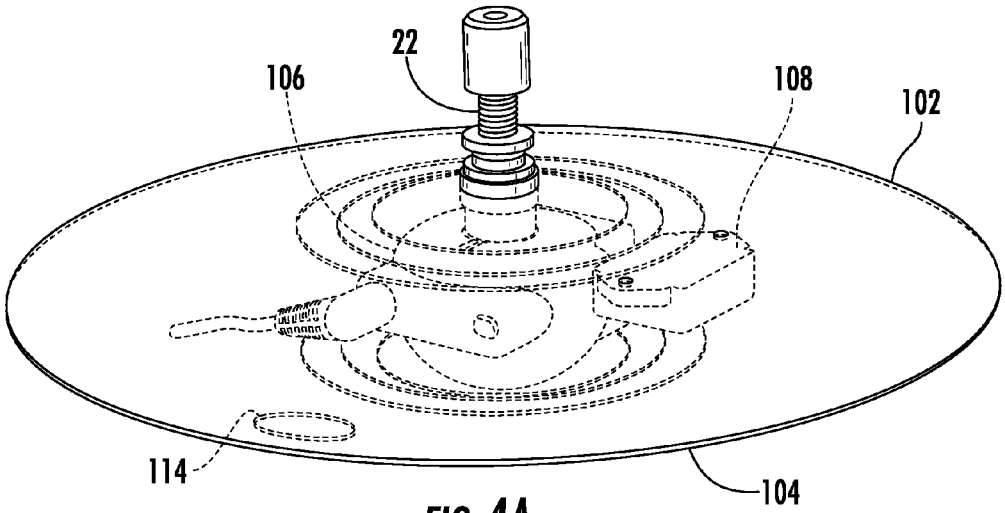
FIG. 4A is a perspective view of the electronic high-hat cymbal controller of the present invention with the cymbals closed.
Figure 4B:
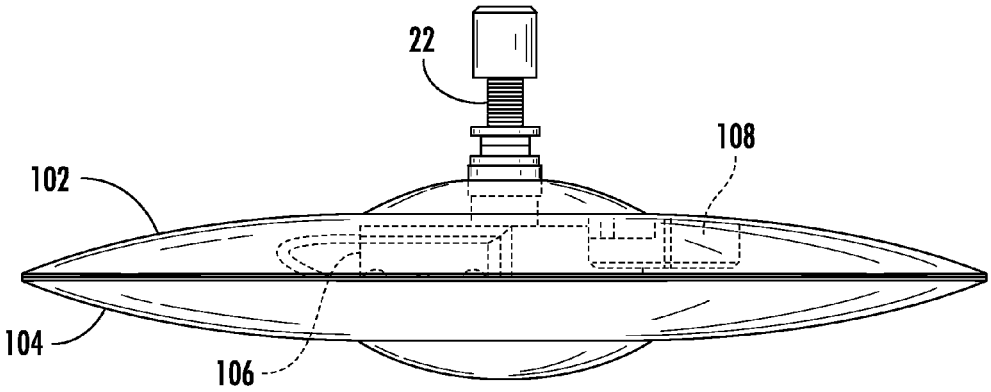
FIG. 4B is a perspective view of the electronic high-hat cymbal controller of the present invention with the cymbals closed.
Figure 5:
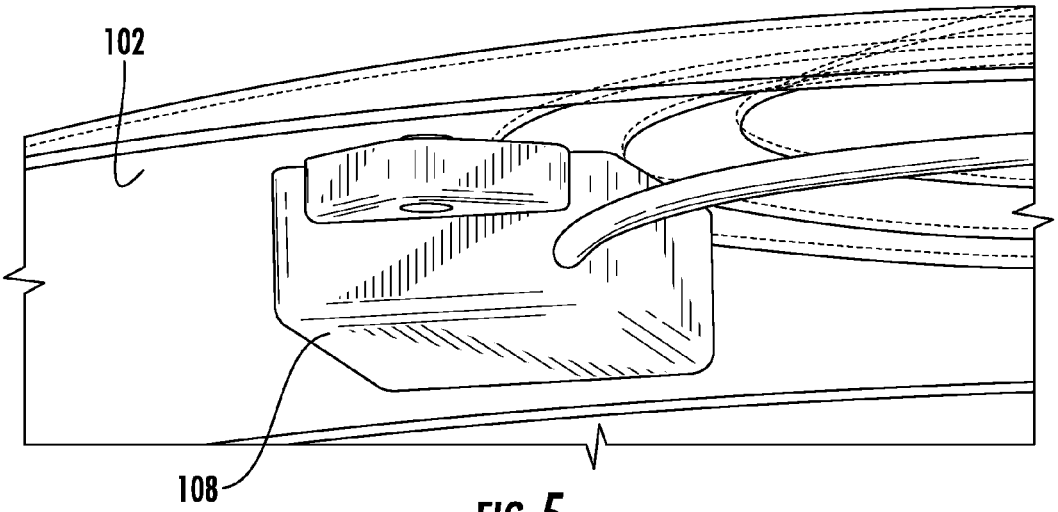
FIG. 5 is a partial bottom perspective view of the bow sensor on the bottom surface of the upper cymbal.

Referring now to FIGS. 3A, 3B, 4A, 4B, and 5, the electronic high-hat cymbal controller of the present invention is shown generally at 100. The electronic high-hat cymbal controller 100 includes an upper cymbal 102 and a lower cymbal 104 operably mounted to a high-hat stand 16 with a foot pedal 18. Further included is a foot pedal control module 106, which will be further described below.

The upper cymbal 102 may be formed from brass like an acoustic cymbal, or another material, such as plastic. Plastic and rubber cymbals are less expensive to produce and produce less "stick noise" when played. The upper cymbal 102 includes a first detector 108 that is configured to detect a strike anywhere on the upper cymbal 102 and return a value proportional to the velocity of the strike. The upper cymbal 102 may further include a second detector 110 in the bell of the cymbal and one or more edge strike detectors 112 along the rim of the upper cymbal 102. Piezo detectors, membrane switches and force sensing resistors may be used to detect strikes against the upper cymbal 102.

The upper cymbal 102 is mounted to a control shaft 22 of a conventional acoustic high-hat cymbal stand 16 with a "V" mount to allow the upper cymbal 102 to swing freely while limiting cymbal rotation on the high-hat cymbal stand 16. Operation of the foot pedal 18 on the high-hat cymbal stand 16 moves the control shaft 22 up and down. Because the upper cymbal 102 is mounted to the control shaft 22, the upper cymbal 102 moves up and down in response to movement of the foot pedal 18.

The lower cymbal 104 may be formed from plastic, brass or other rigid material. The lower cymbal 104 is not designed to detect strikes against it per se, but is present to provide the musician tactile feedback from operation of the high-hat cymbal stand 16 and provide the electronic high-hat cymbal controller 100 of the present invention the look and feel of an acoustic high-hat cymbal stand 10. However the lower cymbal may include sensor, such as an edge strike sensor 112 to provide further fidelity in detecting "speaking", "tcchk" and foot splashes. The lower cymbal 104 may further include a hole 114 through it to allow cables from the upper cymbal 102 and foot pedal control module 106 to be routed to a drum synthesizer module (not shown).

The lower cymbal 104 is mounted to a standard high-hat cymbal stand 10 as the lower cymbal 14 in an acoustic high-hat cymbal 10 would be.

The foot pedal control module 106 is mounted to the high-hat cymbal stand 16 and sits between the upper and lower cymbals 102, 104. The high-hat stand control shaft 22 travels freely through the center of the foot pedal control module 106.

The foot pedal control module 106 includes a rounded bottom so the position of the pedal control module 106 is relatively unaffected by moderate swinging of the lower cymbal 104. The bottom of the foot pedal control module 106 is not fastened or connected to the lower cymbal 104. The top of the pedal control module 106 is not fastened to the upper cymbal 102 either. Depending on the performers preferred setup, the upper cymbal 102 and mounting hardware in the open position may not be in contact with the foot pedal control module 106.

Cables to the drum synthesizer may be loosely fastened (with hook-and-loop cable straps or equivalent) to the high-hat stand 16. Fastening the cables in this manner will limit the rotation of the lower cymbal 104 while allowing it to swing relatively freely. The cables connect to one or more cable jacks on the foot pedal module 106.

The foot pedal control module 106 includes a position detector that senses the position of the upper cymbal 102 relative to the foot pedal control module 106. In one embodiment, a spring-loaded plunger 116 extends above the foot pedal control module 106. A shutter 118 extends from the plunger 116 and is further configured to slide into a channel 120 on a sensor tunnel 122 (described further below). When the upper cymbal 102 is less than a predetermined distance from the lower cymbal 104, it depresses the plunger 116 and compresses spring 124. The foot pedal control module 106 generates and sends a control signal proportional to the plunger 116 position to the drum synthesizer through the cables.

Figure 6:
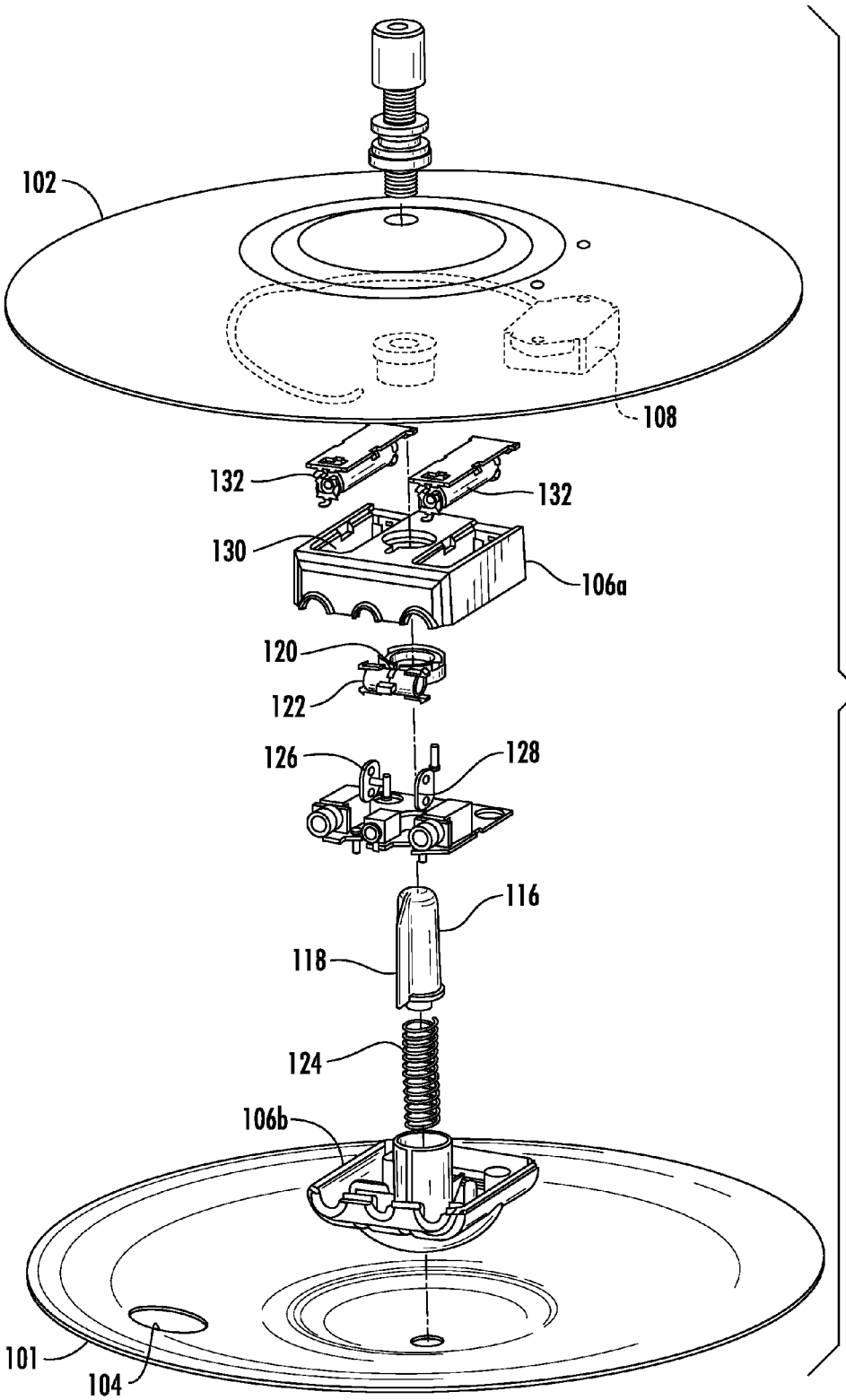
FIG. 6 is an exploded view of the electronic high-hat cymbal controller of the present invention.
Figure 7:
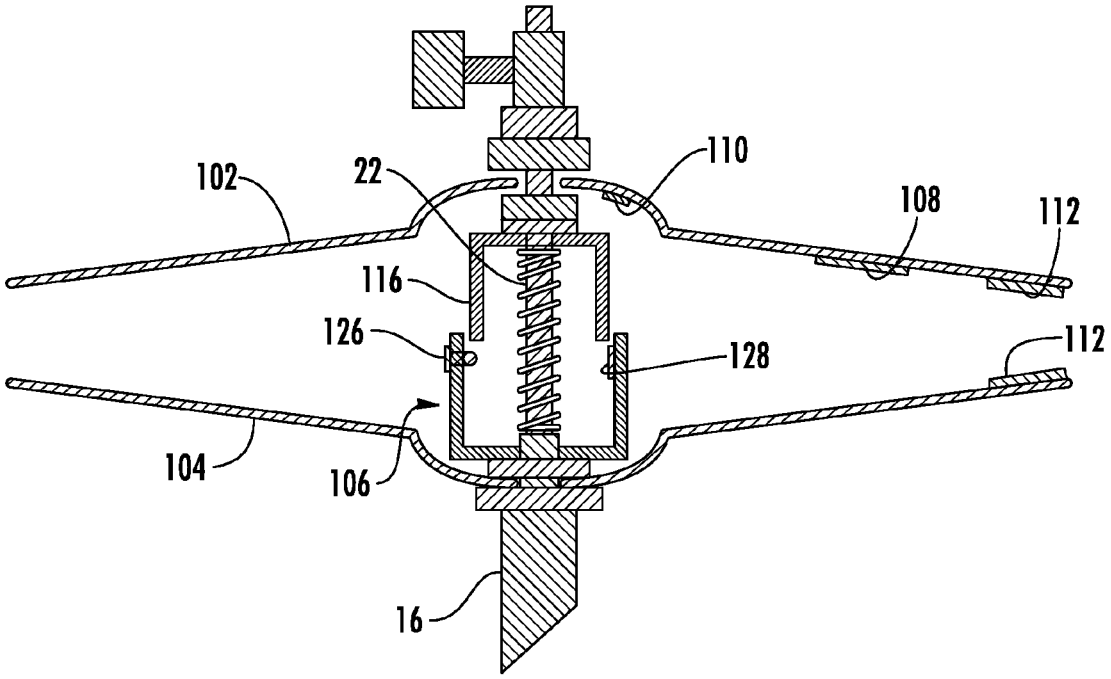
FIG. 7 is a schematic diagram of the electronic high-hat cymbal controller of the present invention.
Figure 8:
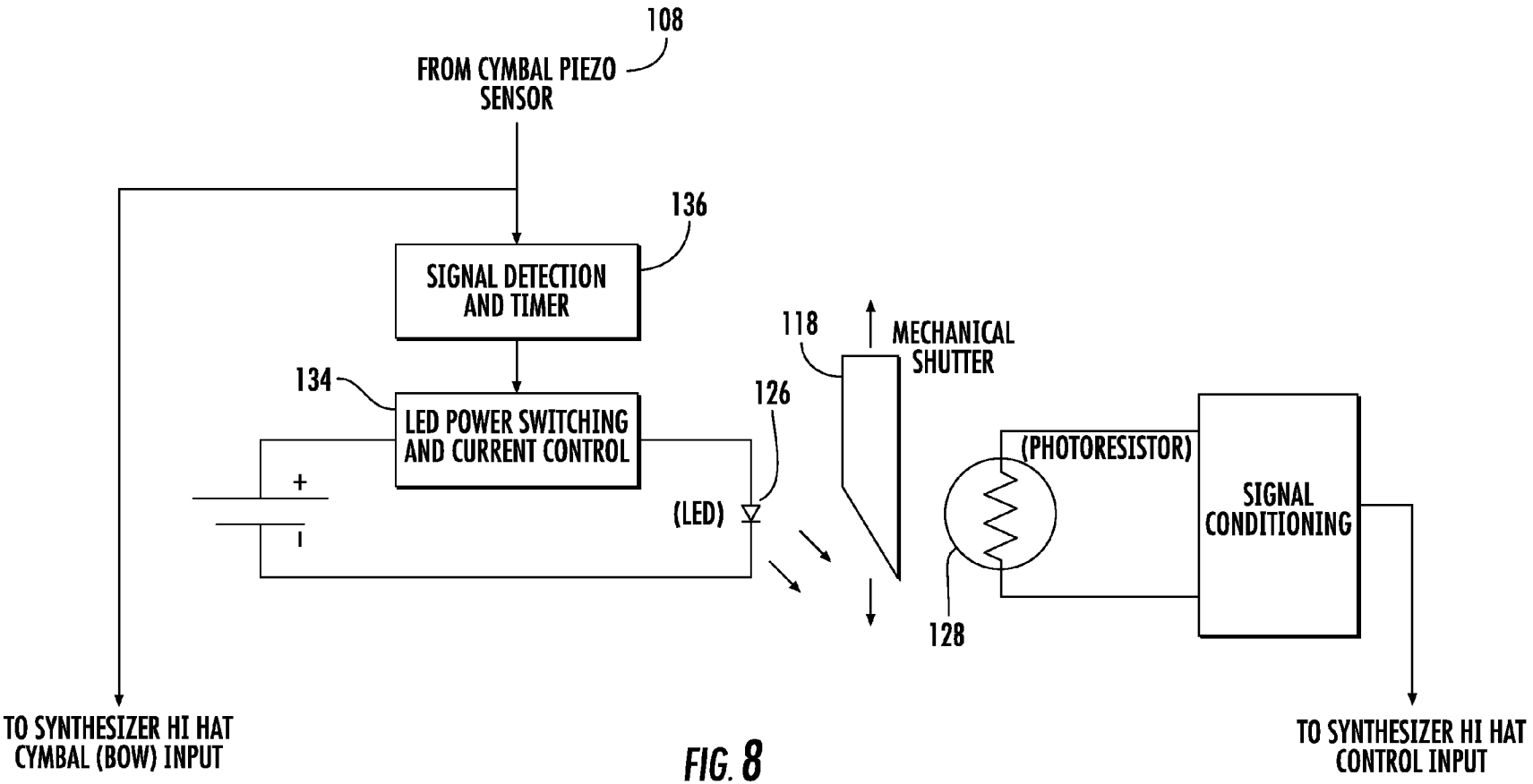
FIG. 8 is a flow diagram of the operation of the foot pedal control module.

Referring now to FIGS. 6-8, to detect the position of the plunger 116, the foot pedal control module 106 includes a light source 126, such as an LED, and an optical detector 128, such as a photo-resistor, positioned opposite the light source 126. A sensor tunnel 122 is positioned between the light source 126 of the optical detector 128. The sensor tunnel 122 includes a channel 120 that bisects the sensor tunnel 122 and is configured to receive the shutter 118 from the plunger 116. Motion of the plunger 116 moves the shutter 118 into the channel 120 of the sensor tunnel 122 and across the light path between the light source 126 and the optical detector 128, changing the effective resistance presented to the drum synthesizer. The use of an optical sensor configuration has the advantage of avoiding any signal quality dependency on parts that may repeatedly rub or press against each other, extending the effective life of the controller 100.

The foot pedal control module 106 further includes a battery compartment 130 for batteries 132 to power the position detector. In one embodiment, the upper cymbal 102 first 108, second 110 and edge strike 112 sensors are routed through the foot pedal control module 106 prior to the drum module.

On any detected strike of the upper cymbal 102, the light source 126 of the position sensor is turned on by the foot pedal control module 106. A power switching and current control circuit 134 is provided. After a pre-determined time-out period, if no additional strikes are detected, the light source 126 will be turned off by the power switching and current control circuit 134, thereby optimizing battery life expectancy. A signal detection and timer circuit 136 is provided to determine measure the time period between cymbal strikes in order to ascertain whether the foot pedal control module 106 should be powered off. In one embodiment the signal detection and timing circuit 136 is connected to the first sensor 108 in the bow of the upper cymbal 102.

The drum module synthesizer can also be configured to supply power to the foot pedal control module 106, thereby removing the need for batteries 132 and a battery compartment 132. In the preferred embodiment, the foot pedal control module 106 may be operable with either batteries 132 or external power and will auto-detect which power source to use. Specifically, the foot pedal control module 106 will default to using power from the external source in order to conserve battery life.

Therefore, it can be seen that the present invention provides a unique solution to the problem of providing a high-hat cymbal controller system that is cost effective, convenient and that emulates as closely as possible the playing feel and response of acoustic high-hat cymbals.

It would be appreciated by those skilled in the art that various changes and modifications can be made to the illustrated embodiments without departing from the spirit of the present invention. All such modifications and changes are intended to be within the scope of the present invention.

What is claimed is:

1. An electronic hi-hat cymbal controller, comprising:

a hi-hat cymbal stand with a foot pedal configured to lift a control shaft;

a lower cymbal supported by the hi-hat cymbal stand;

an upper cymbal supported by the control shaft and oriented over the lower cymbal; and a foot pedal control module comprising a position detector configured to detect the position of the control shaft relative to the foot pedal control module, as the control shaft moves up and down the hi-hat cymbal stand, wherein an electrical signal generated by the foot pedal control module is proportional to the position of the control shaft relative to the foot pedal control module.

2. The electronic hi-hat cymbal controller of claim 1, further comprising a bow sensor attached to the upper cymbal.

3. The electronic hi-hat cymbal controller of claim 1, further comprising an edge sensor on the upper cymbal.

4. The electronic hi-hat cymbal controller of claim 1, further comprising an edge sensor on the lower cymbal.

5. The electronic hi-hat cymbal controller of claim 1, wherein the position detector comprises an optical detector.

6. The electronic hi-hat cymbal controller of claim 1, wherein the position detector comprises a mechanical shutter.

7. The electronic hi-hat cymbal controller of claim 1, wherein the position detector comprises a light source.

8. An electronic hi-hat cymbal controller, comprising:

a hi-hat cymbal stand with a foot pedal configured and arranged to mechanically lift a control shaft;

a lower cymbal supported by the hi-hat cymbal stand;

an upper cymbal supported by the control shaft and oriented over the lower cymbal; and a foot pedal control module comprising a position detector configured to detect the position of the control shaft relative to the foot pedal control module as the control shaft moves up and down the hi-hat cymbal stand, by shining a light from a light source at an optical detector and using a mechanical shutter configured to move with the control shaft between the optical detector and the light source, wherein an electrical signal generated by the foot pedal control module is proportional to the position of the control shaft relative to the foot pedal control module.

9. The electronic hi-hat cymbal controller of claim 8, further comprising a bow sensor attached to the upper cymbal.

10. The electronic hi-hat cymbal controller of claim 8, further comprising an edge sensor on the upper cymbal.

11. The electronic hi-hat cymbal controller of claim 8, further comprising an edge sensor on the lower cymbal.

12. The electronic hi-hat cymbal controller of claim 8, wherein the mechanical shutter is configured and arranged to block light from the optical detector when the hi-hat cymbal is closed.

13. The electronic hi-hat cymbal controller of claim 8, further comprising a sensor tunnel between the light source and the optical detector.

14. The electronic hi-hat cymbal controller of claim 13, wherein the sensor tunnel includes a channel that bisects the sensor tunnel and is configured to receive the mechanical shutter therein.

15. A foot pedal control module for a hi-hat cymbal stand including a foot pedal configured to lift a control shaft, the foot pedal control module position detector comprising:

a position detector comprising:

a body portion configured to be supported by a hi-hat cymbal stand;

an optical detector supported by the body portion;

a light source supported by the body portion and configured to shine light on the optical detector; and a mechanical shutter configured to move with the control shaft between the optical detector and light source, wherein the foot pedal control module is configured to detect the position of the control shaft relative to the foot pedal control module as the control shaft moves up and down the hi-hat cymbal stand, and to generate an electrical signal that is proportional to the position of the control shaft relative to the foot pedal control module.

16. The position detector of claim 15, further comprising a plunger configured to attach to the control shaft of the hit-hat cymbal stand, said plunger carrying the mechanical shutter.

17. The position detector of claim 15, wherein the mechanical shutter is configured to block light from the optical detector when the hi-hat cymbal is closed.

18. The position detector of claim 15, further comprising a sensor tunnel between the light source and the optical detector.

19. The position detector of claim 18, wherein the sensor tunnel includes a channel that bisects the sensor tunnel and is configured to receive the mechanical shutter therein.

20. The foot pedal control module of claim 1, wherein the foot pedal control module is underneath the lower cymbal.

21. The foot pedal control module of claim 1, wherein the foot pedal control module is between the upper and lower cymbal.

* * * * *